US009533520B2

(12) United States Patent
Sathe et al.

(10) Patent No.: US 9,533,520 B2
(45) Date of Patent: Jan. 3, 2017

(54) METHOD OF PRINTING WITH HEIGHT ADJUSTABLE PRINT HEAD

(71) Applicant: Océ-Technologies B.V., Venlo (NL)

(72) Inventors: Kunal Sathe, Venlo (NL); Abraham Thijssen, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/094,651

(22) Filed: Apr. 8, 2016

(65) Prior Publication Data

US 2016/0297219 A1 Oct. 13, 2016

(30) Foreign Application Priority Data

Apr. 10, 2015 (EP) ..... 15163124

(51) Int. Cl.
*B41J 25/308* (2006.01)

(52) U.S. Cl.
CPC ..... *B41J 25/308* (2013.01)

(58) Field of Classification Search
CPC ..... B41J 25/308; B41J 11/20
See application file for complete search history.

(56) References Cited

U.S. PATENT DOCUMENTS 5,518,324 A 5/1996 Campbell et al.
2002/0060705 A1* 5/2002 Koto ..... B41J 3/543 347/8
2007/0025794 A1* 2/2007 Kubin ..... B41J 3/4071 400/605
2008/0136851 A1 6/2008 Masuyama et al.
2008/0240825 A1 10/2008 Furuyama
2009/0190958 A1* 7/2009 Wang ..... G03G 21/1647 399/228
2012/0070251 A1* 3/2012 Nishikawa ..... G06F 17/21 412/13

FOREIGN PATENT DOCUMENTS

EP 0516283 A2 12/1992

* cited by examiner

*Primary Examiner* — Stephen Meier
*Assistant Examiner* — Alexander D Shenderov
(74) *Attorney, Agent, or Firm* — Birch, Stewart, Kolasch & Birch, LLP

(57) ABSTRACT

A method of printing on a mixed sequence of media sheets uses a printer with a print head that is adjustable in height relative to a print surface that supports the media sheets. The media sheets differ in their specifications that define an admissible range for the height of the print head. The method includes the steps of retrieving admissible height ranges for a plurality of media sheets that are scheduled for printing, searching for a height value that is contained in the admissible range of all scheduled sheets, if such a height value is found, adjusting the print head to that height value, and if such height value is not found, proceeding to a problem handling routine.

8 Claims, 4 Drawing Sheets

Fig. 6
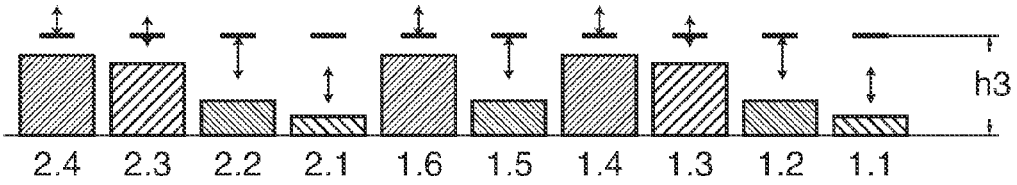
Fig. 7
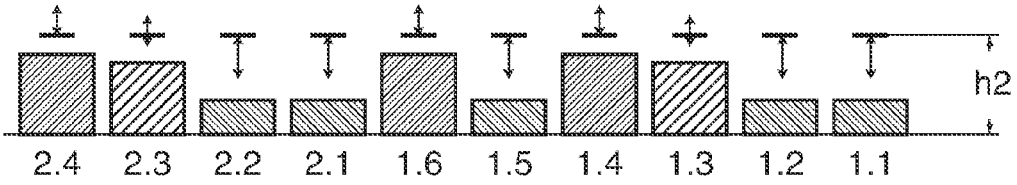
Fig. 8
| Media Type: | A | B | C | D |
|---|---|---|---|---|
| Range: | Ra | Rb | Rc | Rd |
| A | 1.0 | 0.9 | 0.5 | 0.7 |
| B | 0.9 | 1.0 | 0.6 | 0.8 |
| C | 0.5 | 0.6 | 1.0 | 0.4 |
| D | 0.7 | 0.8 | 0.4 | 1.0 |
ML
MCa MCd

METHOD OF PRINTING WITH HEIGHT ADJUSTABLE PRINT HEAD

CROSS-REFERENCE TO RELATED APPLICATIONS

This application claims priority under 35 U.S.C. §119(a) to Application No. 15163124.9, filed in Europe on Apr. 10, 2015, the entire contents of which is hereby incorporated by reference into the present application.

BACKGROUND OF THE PRESENT INVENTION

1. Field of the Invention

The present invention relates to a method of printing on a mixed sequence of media sheets, using a printer with a print head that is adjustable in height relative to a print surface that supports the media during printing, wherein each of the media sheets have different specifications for an admissible height range for the print head relative to the print surface.

2. Description of Background Art

In many printers, e.g. ink jet printers, the print head is disposed at a short distance above the surface of the media sheets that are supported on a print surface, e.g. a conveyer belt, a platen or the like. For simplicity, the term "height" is used here to define the distance between the print surface and a surface of the print head that faces the print surface in a direction normal to the print surface, and it is assumed that the print head is disposed "above" the print surface, although the present invention is not limited to printers where the print surface is oriented horizontally.

In order to obtain a high print quality, it is desired that the distance between the print head and the surface of the media sheets is as small as possible. For example, in an ink jet printer, a small distance between the print head and the media sheets is desired in order to minimize the distance that the ink droplets have to travel and thereby to minimize the amount of aberration of the ink droplets. On the other hand, the print head must, of course, not collide with the media sheets, so that there should always be a certain safety distance between the surface of the media sheets and the print head. This safety distance will depend upon the thickness tolerances of the media sheets, their tendency to cockle or to form wrinkles and the like, so that a lower limit of the admissible range for the height of the print head is derivable from the specifications of the individual types of media sheets. The upper limit of this admissible range may also depend upon the media type, because certain properties of the media sheet, such as their capability to permit the ink droplets to spread over the sheet surface and/or to absorb ink in the interior of the sheet material, have an influence on the tolerable aberration of the ink droplets and consequently on the distance that the ink droplets have to travel.

The media types that are to be used for printing are specified in the print job or print jobs that are to be processed with the printer. The media type may not only vary from print job to print job, but even a single print job may specify that different media types are to be used for different pages of the document to be printed. Consequently, there may be cases where a mixed sequence of media sheets of different types is scheduled for printing. In that case, depending upon the thickness of the different media sheets and on the media specifications, it may be necessary to change the height adjustment of the print head in the interval between the printing periods for two successive sheets.

As the height adjustment of the print head takes a certain amount of time, considerable losses in productivity may occur when the height of the print head has to be re-adjusted frequently.

The losses in productivity are particularly pronounced in duplex printing. In a typical duplex printer, the duplex loop accommodates a plurality of sheets, so that a set consisting of a certain number of sheets is moved past the print head a first time for printing an image on the first side of the sheets, and then these sheets will be returned via the duplex loop and will be moved past the print head a second time in order to form an image on the second side. When this set of sheets contains different media types, each adjustment operation of the print head that has been performed during printing on the first side of the sheets has to be repeated when these sheets return from the duplex loop. Duplex printing may be established batch wise by filling the duplex loop with sheets and then printing each sheet twice, or in a more productive mode of interweaving sheets of a plurality of duplex and/or simplex print jobs. For example, in the interweaving mode, empty sheets alternate with sheets that have already been printed on one side.

SUMMARY OF THE INVENTION

It is an object of the present invention to propose a printing method that permits to mitigate the productivity losses in printing on mixed media.

In order to achieve this object, the method according to the present invention comprises the steps of: retrieving admissible height ranges for a plurality of media sheets that are scheduled for printing; searching for a height value that is contained in the admissible range of all scheduled media sheets; if the height value is found, adjusting the print head to the height value; and if the height value is not found, proceeding to a problem handling routine.

Consequently, at least in the cases where an overlap exists between the admissible height ranges for all the sheets, the print head is adjusted to a height value within this overlap, so that the entire sequence can be printed without having to adjust the height of the print head in-between. Nevertheless, the distance between the print head and the surface of the sheets will always be within a tolerable range, so that a required and consistent print quality can be achieved. When a high print quality is required, the print head is preferably adjusted to a minimum height value within the overlap.

Only in cases where the sheets are so different from one another that there exists no height value that is contained in the permissible height ranges of all media types involved, it will be necessary to proceed to a specific routine for dealing with the problem of incompatible height ranges, e.g. by proceeding with printing in the usual way with height adjustments of the print head where necessary, although the cost of productivity may increase.

More specific optional features of the present invention are indicated in the dependent claims.

In one embodiment, the problem handling routine may comprise or consist of a step of alerting the user that a certain loss in productivity has to be expected. Optionally, the productivity loss may be quantified on the basis of the number of necessary height adjustments.

In addition to a productivity alert, the problem handling routine may also comprise a step of proposing to the user to replace at least one of the media types that have been specified in the print job by another one in order to make the admissible height ranges compatible and thereby to improve the productivity.

In another embodiment, the problem handling routine may comprise a step of adjusting the print head to a height value that is safe for all media types involved but may be larger than the upper limit of the admissible range for at least one media type, and alerting the user that certain losses in print quality have to be expected. Optionally, these losses may also be quantified on the basis of the extent to which the selected height value exceeds the upper limit of the admissible range.

In yet another embodiment, the problem handling routine may comprise a step of dividing the sequence of sheets that are scheduled for printing into two contiguous sub-sequences and then trying to find a height value that fits in all admissible ranges at least within the respective sub-sequences. In that case, only a single height adjustment operation will be necessary during the time in which the entire sequence is printed. If no suitable height value can be found for one or both of the reduced sub-sequences, the procedure may be iterated. The iteration will come to an end at the latest when the sequence has been divided so often that each sub-sequence consists only of a single sheet. In any case, this iteration will minimize the number of necessary height adjustment operations.

It is also possible to select among the different versions of problem handling routines that have been outlined above. The selection may depend upon the results of the preceding steps. For example, when it is found that the productivity loss would be substantial, but could be largely avoided when one of the specified media types is replaced by a very similar other media type, then it will be appropriate to propose a change of the media type, rather than accepting a loss in print quality or trying to split the sequence. On the other hand, when it is found that the expected loss in print quality would not really be significant, it would be appropriate to decide in favor of productivity rather than quality.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 3 to 7 are diagrams similar to FIG. 2 that illustrate different strategies in the method according to the present invention;

FIG. 8 shows a media similarity matrix permitting selection of a suitable media type.

DETAILED DESCRIPTION OF THE PREFERRED EMBODIMENTS

Figure 1:
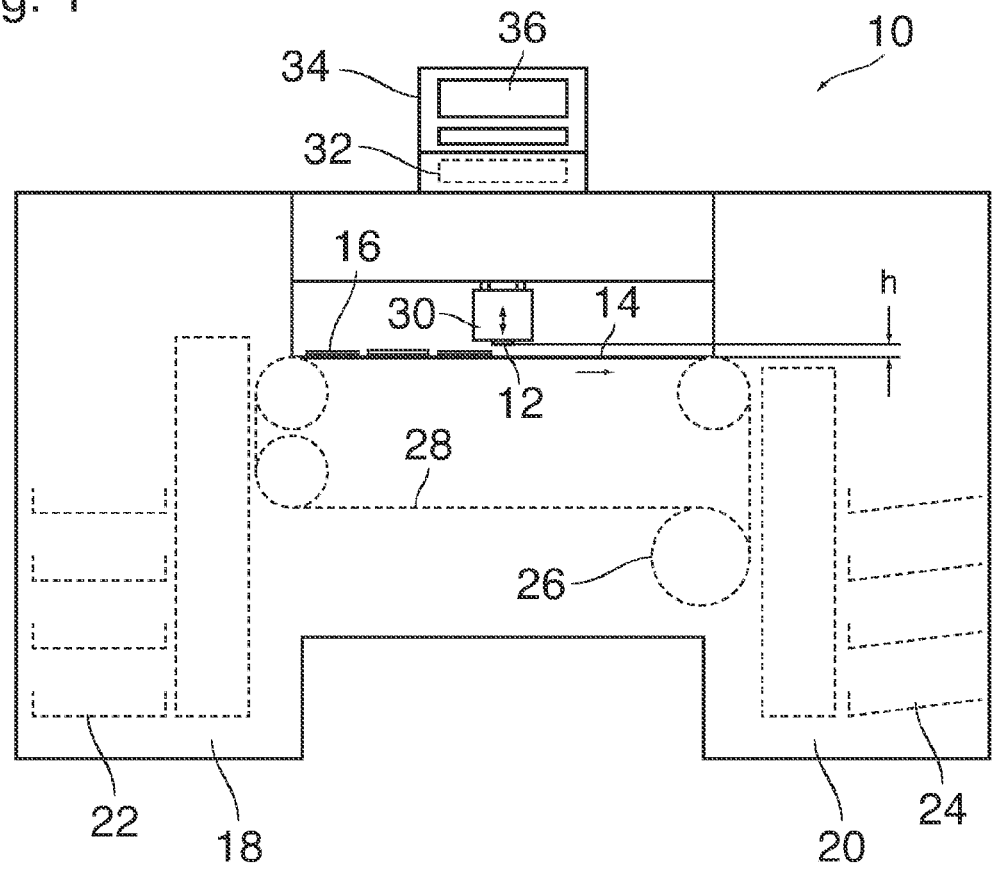
FIG. 1 is a schematic view of an ink jet printer to which the present invention is applicable.

The present invention will now be described with reference to the accompanying drawings, wherein the same reference numerals have been used to identify the same or similar elements throughout the several views.

FIG. 1 shows an example of an ink jet printer 10 comprising a print head 12 that is disposed closely above a print surface 14 and arranged to scan the print surface in the direction normal to the plane of the drawing in FIG. 1.

In this example, the print surface 14 is formed by a conveyer belt arranged to advance a sequence of media sheets from a feed section 18 of the printer past the print head 12 and to a discharge section 20. The feed section 18 includes a plurality of trays 22 for storing stacks of media sheets of different types and is arranged to feed the media sheets of the different types to the print surface 14 in a mixed sequence, depending on media selections that are specified in a print job, as is generally known in the art. The discharge section 20 contains a plurality of discharge bins 24 to which the printed copies are fed in a collated manner.

A sheet reversal mechanism 26 and a duplex loop 28 are provided for returning a collection of sheets 16, on which an image has been printed on the first side, in reversed orientation back to the entry side of the print head for printing another image on the second side.

A height adjustment mechanism 30 is provided for adjusting the height h of the print head 12, more precisely, the height of a bottom face (the nozzle face) of the print head relative to the print surface 14. In this way, the distance that ink droplets ejected from the nozzle face of the print head have to travel before they reach the top surface of the media sheets 16 can be set to a value that assures a high print quality, even when the thickness of the media sheets varies.

The various functions of the printer 10, including the operation of the print head 12, the feed section 18 and the height adjustment mechanism 30 are controlled by an electronic controller 32 that includes also a scheduler for scheduling the sequence in which in the media sheets of different types are withdrawn from the trays 22 and fed to the print surface in accordance with the instructions in the print job. An operating console 34 including a display 36 is provided for permitting a user or operator to enter operating instructions and for displaying messages to the user or operator.

When the media sheets that are scheduled for printing are all of the same type, the print head 12 may be adjusted to a suitable height h, and then the media sheets may be moved past the print head in rapid succession without stopping the conveyer and with only small intervals between the successive sheets. However, when the sequence contains media sheets of different types, it may be necessary to adjust the height h of the print head when one sheet has been printed and before the next sheet reaches the print head. In that case, in order to provide sufficient time for the height adjustment of the print head, it is necessary to either stop the conveyer temporarily or to provide larger gaps between the successive media sheets. In any case, more time will be needed for completing the print process, so that the productivity of the printer decreases.

The duplex loop 28 is capable of accommodating a certain maximum number of media sheets. Consequently, in a first case, the sequence of sheets that are scheduled for printing is divided into a plurality of batches, each of which contains not more than the maximum number of sheets that the duplex loop can accommodate, and the supply of the sheets will be controlled such that batches in which an image is printed on the first side of the sheets alternate with batches in which an image is printed on the second side of the sheets that have been returned via the duplex loop. When such a batch contains at least one sheet that requires a re-adjustment of the height h of the print head, it is necessary to perform at least two height adjustment operations, one when the batch is processed the first time and one when it is processed a second time after it has returned from the duplex loop. Consequently, productivity losses are particularly severe in duplex printing.

In a second case, duplex printing is established in an interweaving mode where empty sheets alternate with sheets that have already been printed on one side. In the interweaving mode, the sequence of sheets may be interweaved in such a way that the number of height adjustment operations is reduced by scheduling sheets having the same height requirement next to each other when merging the two sheet streams in the duplex loop.

Figure 2:
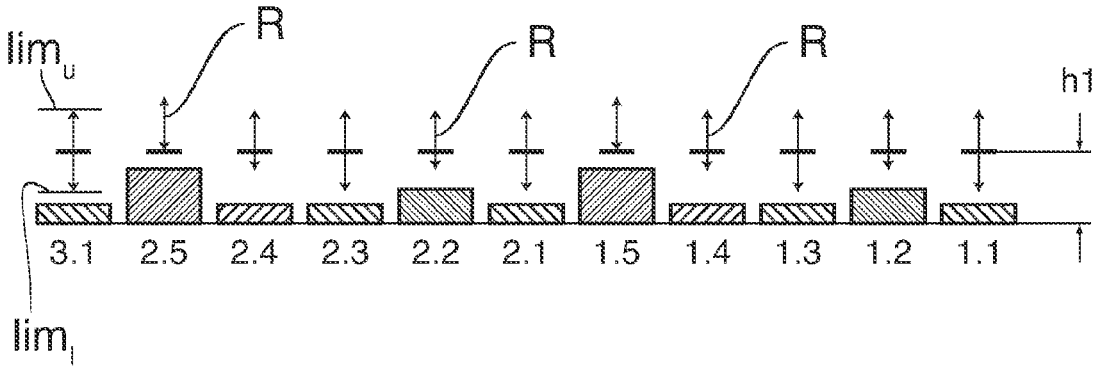
FIG. 2 is a diagram illustrating a mixed sequence of media sheets and related admissible ranges for the height of a print head.

FIG. 2 is a diagram illustrating a printing method for processing a print job that consists in printing several copies of a five page document (simplex printing). The hatched rectangles in FIG. 2 symbolize the media sheets arranged in the sequence (from right to left in FIG. 2) in which they are scheduled for printing. Thus, sheet 1.1 is a sheet that is to form the first page of a first copy of the document, the sheets 1.2-1.5 are intended to become pages 2 to 5 of the first copy, sheet 2.1 is intended to become the first page of the second copy of the document, and so on.

In the example shown, the media types of the sheets 1.1-3.1, as specified in the print job, differ in thickness (as symbolized by different heights of the rectangles in FIG. 2) and they also differ in material or coating, as symbolized by different hatchings of the rectangles in FIG. 2. For each of the sheets, an admissible range R for the height h of the print head 12 above the print surface 14 is symbolized by a double arrow. For each given position of the print head 12, the height h of the print head 12 is defined as the minimum distance between the print head 12 and the print surface 14. If the bottom face of the print head 12 is parallel to the print surface 14, the height h is equal to the distance between the bottom face of the print head 12 and the print surface 14. If the bottom face of the print head 12 is not parallel to the print surface 14, the height h is equal to the minimum distance between a point of the bottom face of the print head 12 and the print surface 14. As has been shown for the leftmost sheet 3.1, each admissible range R is bounded by a lower limit $\lim_l$ and an upper limit $\lim_u$. Obviously, the lower limit $\lim_l$ must always be larger than the thickness of the sheet. Further, a certain safety distance has to provided in order to reliably prevent a collision of the print head with the sheet. The lower limit $\lim_l$ may be different, even for sheets which have the same thickness (such as the sheets 1.3 and 1.4), because the expected unevenness of the top surface of the sheet depends upon the sheet material, and the safety distance must be larger when the unevenness of the sheet is expected to be larger.

When the height of the print head above the top surface of the sheet is increased, this means that the droplets ejected from the print head have to travel a larger distance, and the aberration of the droplets in horizontal direction may be larger. The upper limit $\lim_u$ indicates the height that should not be exceeded in order to assure an acceptable print quality. However, since the size of the ink dots formed on the sheet surface will depend upon the properties of the sheet (material or surface coating), the tolerable aberrations of the ink droplets may vary from sheet type to sheet type, and consequently, the upper limit $\lim_u$ may vary dependent upon the sheet material.

In order to obtain an optimal print quality, it would be desired to adjust the height h of the print head to the lower limit $\lim_l$ for each individual sheet. However, in the example shown, this would mean that the height of the print head would have to be changed by means of the height adjustment mechanism 30 each time a single sheet has been printed. As a result, the process would be extremely time-consuming.

In order to increase the productivity, the method illustrated in FIG. 2 is based on the following principle. The admissible ranges R of all the sheets that are scheduled for printing, at least of all sheets of the given print job, are analyzed in order to see whether there is an overlap between the admissible ranges R of the different sheets. In case of a print job that consists in printing multiple copies of a multi-page document, the analysis may be limited to the sheets that form the pages of one copy of the document because the sheet sequence is repetitive and will be the same for each copy of the document.

In the example shown in FIG. 2, fortunately, there is an overlap between the admissible ranges R of all five sheets (e.g. sheets 1.1-1.5) of the document. It is therefore possible to find a height value h1 that is contained in the admissible ranges R for all sheets. The height h of the print head 12 is therefore adjusted to this height value h1, so that it is possible to use a constant height of the print head for the entire job. In the diagrams in FIGS. 2 to 7, the height value to which the print head is adjusted for an individual sheet is symbolized by a bold horizontal bar above the rectangle that symbolizes the sheet.

More specifically, in FIG. 2, the height value h1 has been selected to be the lower limit $\lim_l$ of the admissible range R for the thickest sheet 1.5 in the job. This will assure that the print quality is as high as is possible without changing the height of the print head.

Figure 3:
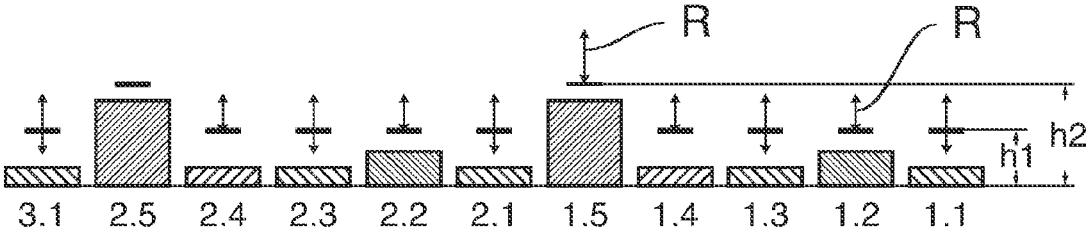

In practice, there is of course no guarantee that a height value that is suitable for all pages can always be found. FIG. 3 illustrates an example of a mixed sheet sequence in which such a unique height value does not exist. Although there exists an overlap between the admissible ranges R of the sheets 1.1-1.4, the sheet 1.5 does not fit. The lower limit of its admissible range is larger than the upper limit of the admissible ranges of all the other sheets.

It is possible however to divide the sequence of sheets into two contiguous sub-sequences, one consisting of the sheets 1.1-1.4 and the second one consisting only of the sheet 1.5. Then, a common height value h1 can be selected for the first sub-sequence, and another height value h2 has to be selected for the second sub-sequence (only the sheet 1.5 in this example). In this way, it is at least possible to reduce the number of necessary height adjustment operations to two per copy, i.e. one adjustment operation between the times where the sheets 1.4 and 1.5 are printed, and another one between the times at which the sheets 1.5 and 2.1 are printed.

Productivity may be increased further if it is not required that the pages of the various copies of a document are all printed in the same order, e.g. if the discharge section 20 is capable of re-collating and re-ordering the sheets. For example, if the discharge section 20 includes another sheet reversal mechanism, then the method illustrated in FIG. 3 may be modified as follows.

The first copy of the document, with pages 1.1-1.5, is printed in the same way as in FIG. 3. Then, the second copy with pages 2.2-2.5 is printed with reversed page order, i.e. sheet 2.5 is printed immediately after sheet 1.5, then followed by sheet 2.4, and so on. This has the advantage that the print head is already adjusted to the correct height when the print process proceeds from sheet 1.5 to 2.5. Consequently, the necessary number of height adjustment operations for printing the sheets 1.1-2.5 is reduced from four to two. The sheets 2.1-2.5 will then be reversed in orientation by the sheet reversal mechanism in the discharge section 20 and will be discharged face-down into another bin 22. Consequently, all the copies will be discharged in collated manner, with the only difference being that the copies in one bin 22 will be oriented face up and the copies in the other bin face down.

Figure 4:
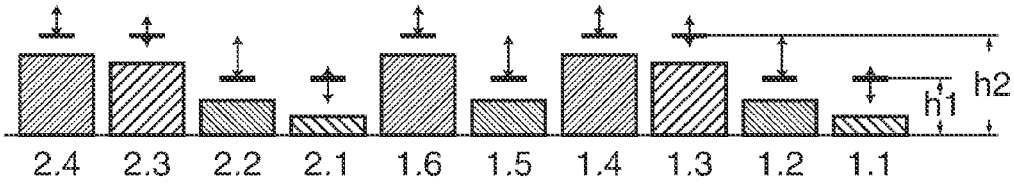

FIG. 4 illustrates an example (of simplex printing) wherein the admissible range for sheet 1.1 overlaps with the admissible range for sheet 1.2, the admissible range for sheet 1.2 overlaps with the admissible ranges for sheets 1.3 and 1.4, but the admissible ranges for 1.1 on the one hand and 1.3 and 1.4 on the other hand do not overlap. Sheet 1.5 is of the same media type as sheet 1.2, and sheet 1.6 is of the same media type as sheet 1.4. The document to be printed has six pages so that sheet 2.1 becomes the first page of the second copy.

In the example shown in FIG. 4, the height of the print head can be kept in the admissible range for all sheets by selecting a height value h1 for the sheets 1.1, 1.2 and 1.5, and a different height value h2 for the sheets 1.3, 1.4 and 1.6. However, this has the consequence that as many as four height adjustment operations per copy are needed.

Figure 5:
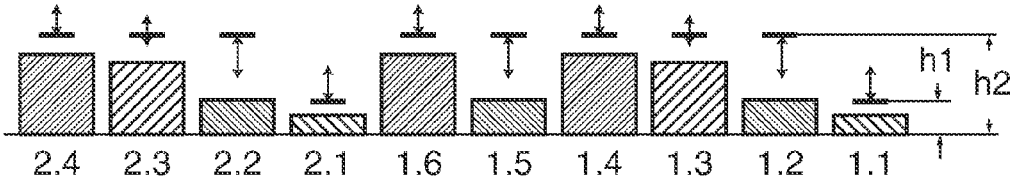

FIG. 5 illustrates a more efficient printing method for the same print job as in FIG. 4. Here, the first height value h1 has been set to give an optimal print quality for sheet 1.1. This height value h1 can however be used only for the one sheet 1.1. The second height value h2 has been selected to fit in the admissible ranges for all the other sheets 1.2-1.6. This has the consequence that the print quality for sheets 1.2 and 1.5 may not be quite as high as in FIG. 4, but on the other hand the number of necessary height adjustment operations is reduced to only two per copy, so that the productivity is increased significantly. In order to optimize productivity, it should therefore always be attempted to keep the number of sub-sequences, in which the sheet sequence has to be split, as small as possible.

FIG. 6 illustrates another printing method for the same print job as in FIGS. 4 and 5. Here, a maximum productivity is achieved by selecting a single height value h3 for the entire job. This height value h3 fits within the admissible ranges for the sheets 1.2-1.6, but falls out of the admissible range for sheet 1.1, which means that print quality for sheet 1.1 has been sacrificed. The controller 32 may offer this option to the user automatically via the display 36, but should alert the user that this comes at the cost of quality.

FIG. 7 illustrates an alternative printing method which can also achieve a maximum productivity for the same print job as in FIGS. 4 to 6. In this method, it is proposed to the user to modify the media type instructions in the print job by using a different type of media sheets for page 1, i.e. sheets 1.1, 2.1, etc. In the example shown, the new media type for sheet 1.1 is the same as for sheet 1.2, so that an acceptable print quality can be achieved without any loss in productivity.

The properties of the different types of print media are commonly stored in the form of a data base in a so-called media catalogue which may be stored in the controller 32 or to which the controller has access via a network. The properties stored in the media catalogue permit to determine the admissible range for each media type. Further, the properties of each media type may be categorized by defining a number of qualities such as color, surface gloss, stiffness, water resistivity and the like, and by assigning a numerical quality parameter to each quality and each media type. Then, by calculating a correlation between the quality parameters for each pair of media types, it is possible to obtain a similarity measure that indicates the extent to which the properties of two different media types are similar.

In FIG. 8, such similarity measures have been entered into a similarity matrix for four different media types A, B, C and D. Further, the admissible ranges Ra, Rb, Rc and Rd for the print head height adjustment have been indicated for each media type. The similarity measure is a value that varies between 0.0 and 1.0, the value 1.0 meaning that the properties are identical. Consequently, the similarity matrix is a symmetric matrix with entries 1.0 on the main diagonal.

When the sequence of sheets has been scheduled for printing, the admissible ranges R of all these sheets are analyzed to see whether a unique height value h1 that fits for all sheets can be found. If it is found that such a value does not exist because a media type of one or more of the scheduled sheets, e. g. the media type B in FIG. 8, has an admissible range Rb that does not overlap with the admissible ranges of the other sheets, then the matrix line ML that is assigned to this media type B is investigated in the similarity matrix. Further, it is checked which other media types have an admissible range (Ra, Rb) that would overlap with the admissible ranges for the other scheduled sheets. In the example shown, it is assumed that this is the case for the media types A and D, as has been indicated in FIG. 8 by highlighting corresponding matrix columns MCa and MCd. Then, by comparing the similarity measures in the matrix cells in line B and column A (0.9) and line B and column D (0.8), it is found that the media type A has the highest degree of similarity with the media type B. Consequently, it is proposed to replace the media type B by the type A.

Figure 9:
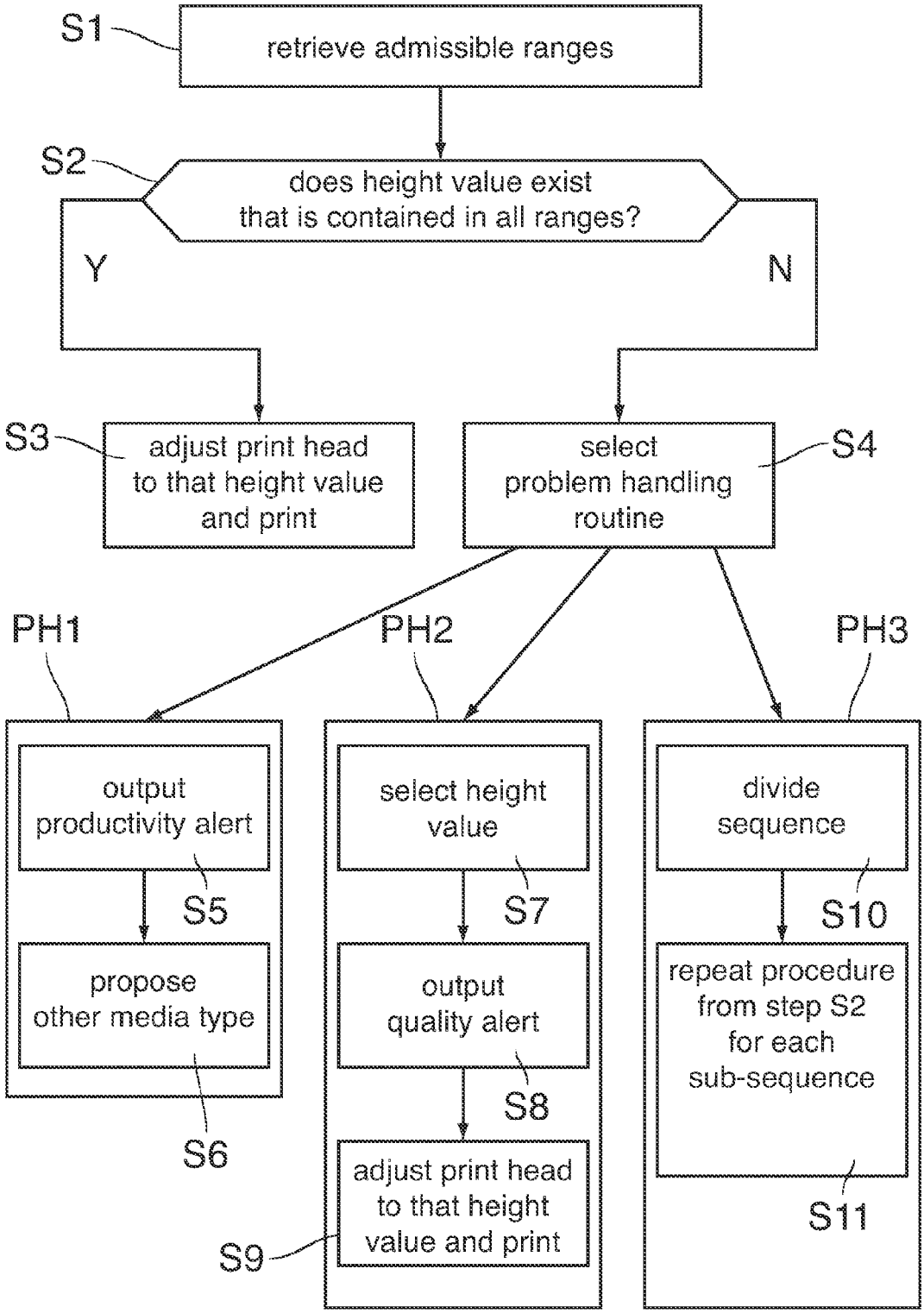
FIG. 9 is a flow diagram illustrating essential steps of a method according to the present invention.

A flow diagram illustrating possible process flows in a printing method according to the present invention, embodying the principles described above, has been shown in FIG. 9.

When a sequence of media sheets to be supplied to the print surface 14 is being scheduled by the controller 32, the admissible ranges R for the media types of these sheets are derived from the media catalogue in step S1. The sheets that are considered here may belong to a single duplex or simplex print job but might as well belong to a plurality of print jobs waiting in a print cue for the printer.

Then, it is checked in step S2 whether a unique height value h1 exists that fits for all sheets, i.e. that is contained in the admissible ranges R for all the scheduled sheets. If that is the case, (Y), then the print head 12 is adjusted to that height value h1 in step S3, and the sheets are printed with maximum productivity.

If no such unique height value can be found in step S2 (N), then one of a plurality of predefined problem handling routines PH1, PH2 or PH3 is selected in step S4.

In a simple embodiment, just one problem handling routine PH1 may be available, which simply consists in alerting the user that a loss in productivity must be expected (step S5). Optionally, the loss in the activity may be quantified in the alert, e.g. by indicating the estimated time that will be needed for completing the job and/or by indicating a percentage by which the expected time will exceed the time that would be needed if printing an optimal productivity would be possible. It may then be left to the user to decide whether he accepts the loss in productivity or whether he turns to another printer or modifies his print job.

In the more elaborate embodiment shown here, the step S5 is supplemented by another step S6 in which one or more alternative media types are selected (by reference to a similarity matrix as shown in FIG. 8) and are proposed to the user, optionally with an indication of the degree of similarity and/or the differences in the properties of the media. Then, the user may decide whether to change the media type as proposed or to print with reduced productivity.

Another possible problem handling routine PH2 starts with a step S7 of selecting a height value that leads to a loss in quality, as in FIG. 6, and outputting a quality alert, in step S8 in which the user is asked whether he is prepared to accept a certain loss in quality. Optionally, the expected loss in quality may be quantified further, based on the difference between the proposed height value (e.g. h3 in FIG. 6) and the upper limit of the admissible range R for the pertinent sheet (sheet 1.1 in FIG. 6).

Then, if the user accepts the loss in quality, the height value (h3) that fits for all the other sheets is selected and used for printing in step S9.

Yet another available problem handling routine PH3 attempts, in a step S10, to divide the scheduled sequence of sheets as has been illustrated in any of the FIGS. 3, 4 and 5. In a subsequent step S11, the procedure starting with step S2 is re-iterated for each of the sub-sequences that have been specified in step S10. If that does not lead to a satisfactory result (step S3) immediately, the step S4 may be repeated for each of the sub-sequences. When the routine PH3 is selected, the step S10 may comprise selecting another possibility to divide the original sequence into two sub-sequences. When all possible divisions of the original sequence have been tested, the step S10 may also comprise dividing the sub-sequences further into sub-sub-sequences.

The decision in step S4 may be automated, based on certain pre-defined criteria. For example, these criteria may specify that the routine PH1 is selected if the expected loss in productivity is relatively small and/or can be avoided by selecting a media type that is very similar to the type that was originally intended. Further, these criteria may specify that the routine PH2 is selected if the expected loss in productivity would be large, but the expected loss in quality would be relatively small. Further, the criteria may specify that the routine PH3 is selected if the criteria for none of the other routines PH1 and PH2 are met.

It will be understood that at least one of the criteria that are checked in step S4 may be set or modified by the user, so that the user may, for example, give highest priority to productivity or highest priority to quality, or specify a certain minimum quality level.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method of printing on a mixed sequence of media sheets, using a printer with a print head that is adjustable in height relative to a print surface that supports the media sheets, wherein each of the media sheets have different specifications for an admissible height range for the print head relative to the print surface, said method comprising the steps of:

retrieving admissible height ranges for a plurality of media sheets that are scheduled for printing;

searching for a height value that is contained in the admissible range of all scheduled media sheets; and if the height value is found, adjusting the print head to the height value;

if the height value is not found, proceeding to a problem handling routine, wherein the problem handling routing comprises the steps of:

identifying a media type for at least one of the scheduled media sheets that does not overlap with the admissible ranges for the other scheduled sheets;

selecting, from a set of predefined media types, another media type that has an admissible range that does overlap with the admissible ranges of the other scheduled media sheets; and proposing to a user of the printer to replace the identified media type by said another media type.

2. The method according to claim 1, wherein the step of proceeding to the problem handling routine comprises a step of alerting a user of the printer to an expected productivity loss.

3. The method according to claim 1, further comprising the step of selecting said another media type by reference to a similarity matrix that indicates the similarities in properties between the predefined media types.

4. The method according to claim 1, wherein the step of proceeding to the problem handling routine includes the steps of:

selecting a height value that fits in the admissible range for a majority of the scheduled media sheets, but exceeds an upper limit of an admissible range for at least one of the scheduled media sheets; and alerting a user of the printer to an expected loss in quality.

5. The method according to claim 1, wherein the step of proceeding to the problem handling routine includes the steps of:

dividing the sequence of scheduled media sheets into two continuous sub-sequences; and searching, for each of the two continuous sub-sequences, for a height value that is contained in the admissible range of all media sheets of the sub-sequence.

6. The method according to claim 1, wherein the admissible range has a lower limit, which takes a safety distance from the print head to the media into account, and wherein the admissible range has an upper limit, which assures an acceptable print quality.

7. A software product embodied on a non-transitory computer readable medium and containing program code, that, when run on a controller of a printer, causes the controller to perform the method according to claim 1.

8. A printer adapted for printing on a mixed sequence of media sheets, comprising:

a print head that is adjustable in height relative to a print surface that supports the media sheets, each of the media sheets having different specifications for an admissible height range for the print head relative to the print surface; and a controller configured to perform the steps of:

retrieving admissible height ranges for a plurality of media sheets that are scheduled for printing;

searching for a height value that is contained in the admissible range of all scheduled media sheets; and if the height value is found, adjusting the print head to the height value;

if the height value is not found, proceeding to a problem handling routine, wherein problem handling route comprises the steps of:

identifying a media type for at least one of the scheduled media sheets that does not overlap with the admissible ranges for the other scheduled sheets;

selecting, from a set of predefined media types, another media type that has an admissible range that does overlap with the admissible ranges of the other scheduled media sheets; and proposing to a user of the printer to replace the identified media type by said another media type.

* * * * *